US006346014B1

(12) United States Patent
Griesser et al.

(10) Patent No.: US 6,346,014 B1
(45) **Date of Patent: *Feb. 12, 2002**

(54) MEDICAL CONNECTOR SYSTEM AND METHOD OF USE

(76) Inventors: Hans Patrick Griesser, 1168 NE. Sunset Loop, Bainbridge Island, WA (US) 98110; Eric Jonsen, 7956 10th Ave. SW., Seattle, WA (US) 98106; Patrick L. Hauge, 4629 164th Ave. SE., Bellevue, WA (US) 90006; Robert Feuersanger, 16 Westwind Rd., Andover, MA (US) 01810

( * ) Notice: Subject to any disclaimer, the term of this patent is extended or adjusted under 35 U.S.C. 154(b) by 0 days.

This patent is subject to a terminal disclaimer.

(21) Appl. No.: 09/562,464

(22) Filed: May 1, 2000

(51) Int. Cl.[7] ..... H01R 13/64
(52) U.S. Cl. ..... 439/680; 439/909
(58) Field of Search ..... 439/680, 674, 439/677, 909, 205

(56) References Cited

U.S. PATENT DOCUMENTS

| | | | | | |
|---|---|---|---|---|---|
| 3,137,535 | A | * | 6/1964 | Collier et al. | 439/680 |
| 3,399,374 | A | * | 8/1968 | Pauza et al. | 439/680 |
| 5,951,598 | A | | 9/1999 | Bishay et al. | 607/142 |
| 5,967,817 | A | | 10/1999 | Greenstein | 439/205 |
| 6,048,218 | A | * | 4/2000 | Greenstein | 439/680 |

* cited by examiner

*Primary Examiner*—Tho D. Ta

(57) ABSTRACT

A medical connector and adapter system that includes: a male cable connector, and a female cable-receiving housing for electrically coupling with the male cable connector. The male cable connector has a keying protrusion that corresponds to a keying channel in the cable-receiving housing. The keying feature prevents the male cable connector from being installed into a cable-receiving housing that does not have a keying channel.

17 Claims, 5 Drawing Sheets

MEDICAL CONNECTOR SYSTEM AND METHOD OF USE

The invention is directed towards a medical connector apparatus. More particularly, this invention is directed towards a medical connector apparatus system that provides a keyed electrode connector or adapter for use in the system.

BACKGROUND OF THE INVENTION

Sudden cardiac death is the leading cause of death in the United States, with one person dying every two minutes. Most sudden cardiac death is caused by ventricular fibrillation ("VF"), in which the heart's muscle fibers contract without coordination, thereby interrupting normal blood flow to the body. When VF occurs, the patient loses consciousness as a result of the interruption in blood flow. The only known effective treatment for VF is electrical defibrillation, in which an electrical pulse is applied to the patient's heart. The electrical pulse must be delivered within a short time after onset of VF in order for the patient to have any reasonable chance of survival. Electrical defibrillation may also be used to treat shockable ventricular tachycardia ("VT"). Accordingly, defibrillation is the appropriate therapy for any shockable rhythm, i.e., VF or shockable VT. In delivering defibrillation therapy to treat VF or shockable VT, because the cardiac rhythm is disorganized, delivery of therapy is not synchronized to the cardiac rhythm. Defibrillators include manual defibrillators and automatic or semi-automatic defibrillators (AEDs).

Because of the size and complexity, manual defibrillators are typically used only by emergency medical personnel with advanced training in interpreting ECG signals. AEDs on the other hand, may be used by lay persons with minimal training because AEDs are designed to analyze the heart rhythm and to determine the appropriateness of defibrillation therapy for the user. Thus, the user of the AED need only know how to deploy the AED and, in the case of semi-automatic AEDs, activate therapy delivery upon AED instruction.

As the use of AEDs has become increasingly common, it has become important for defibrillators, particularly AEDs, to be able to treat a wide variety of patients using one device. An example, is the ability to treat pediatric patients (defined by the American Heart Association as children 8 years of age or less). See, www.amhrt.org. As new devices are built that take into consideration the need to deliver defibrillation to a wide variety of patients, changes to electrode pad designs will result to accommodate these needs. However, because older AEDs are not configured to accommodate multiple electrode pad configurations, such as pediatric electrode pads, it is important that such new pads are not usable in those devices. Equally important, is the fact that as newer AEDs become increasingly multi-function, they will still operate effectively with previous electrode pad configurations. Therefore, what is needed is a medical connector system that accepts currently manufactured electrodes that are system compatible while also accommodating newly designed electrodes that include additional functionality supported by the defibrillator.

SUMMARY OF THE INVENTION

An electrical medical connector or adapter apparatus is provided comprising: a cable-receiving housing having an interior chamber, a semi-cylindrical surface extending into the interior chamber, two housed electrical connectors, a front end having a first aperture for receiving a male cable connector and the cable receiving housing having a keying channel extending out of the interior chamber from the front end, along a portion of the length of the interior chamber. A male cable connector is inserted into the first aperture of the cable-receiving housing, and the male cable connector comprising two electrical conductors electrically connected to the housed electrical connectors. The male cable connector may further comprise a conductive socket electrically connected to each of the two electrical conductors and an expandable tube surrounding each conductive socket, the expandable tubes expanding when the sockets make electrical connection with the housed electrical connectors. A wiping portion may be adapted in the male connector to providing a wiping action to the housed electrical connectors. Further, a semi-cylindrical channel may be formed in the exterior of the male cable connector. In that case, the semi-cylindrical channel adapted to slide over and surround a semi-cylindrical surface of the cable-receiving housing when the cable connector is inserted into the cable-receiving housing. A light covering portion may be provided on the male connector such that the light covering portion is surrounded by semi-cylindrical surface of housing unit when the male cable connector is inserted in the housing unit. The male cable connector may further comprise a keying protrusion along a portion of its length corresponding to the keying channel of the cable-receiving housing.

In another embodiment, a male cable connector is provided comprising: a shell having an interior surface and an exterior surface; two electrical conductors electrically connected to two conductive sockets forming the interior surface of the shell; a semi-cylindrical channel formed in the shell adapted to slide over and surround a semi-cylindrical surface of a housing unit into which the cable connector is inserted to make electrical contact between the cable connector and the housing unit; and a keying protrusion located on the exterior of the shell. The male cable connector may further comprise a wiping portion adapted to providing a wiping action to electrical connectors of a cable-receiving housing into which the male cable connector is inserted to make electrical contact between the cable connector and the housing unit. Alternatively, the male cable connector may further comprise a light covering portion extending over the channel and adapted to cover a light disposed within the channel when the male cable connector is inserted in the housing unit to make electrical contact between the cable connector and the housing unit. These features may co-exist, or exist separately.

In yet another embodiment, a medical connector apparatus is provided comprising: a cable-receiving housing and an electrical medical cable connector, the cable-receiving housing having an interior chamber, the cable-receiving housing forming a semi-cylindrical surface extending into the interior chamber, the cable-receiving housing further forming a keying channel extending out of the interior chamber from the front end of the cable-receiving housing along a portion of the length, the cable-receiving housing further comprising two housed electrical connectors therein, and a front end having an aperture for receiving a male cable connector, wherein the male cable connector comprises, two electrical conductors electrically connected to two conductive sockets within a shell of the male cable connector, wherein each of the conductive electrical sockets of the male cable connector are connected to each of the electrical conductors; and a semi-cylindrical channel formed in the shell adapted to slide over and surround the semi-cylindrical surface of the housing unit when the cable connector is inserted to make electrical contact between the cable connector and the housing unit. The electrical medical connector apparatus may further comprise a wiping portion adapted to providing a wiping action to the housed electrical connectors. The housing unit may be formed from a rigid material and the cable connector may be formed from a pliable material.

In yet another embodiment, an electrical medical connector apparatus is provided comprising: a cable-receiving housing and an electrical medical cable connector, the cable-receiving housing having an interior chamber, the cable-receiving housing forming a semi-cylindrical surface extending into the interior chamber, the cable-receiving housing further forming a keying channel extending of the interior chamber from the front end of the cable-receiving housing along a portion of the length, the cable-receiving housing further comprising two housed electrical connectors therein, and a front end having an aperture for receiving an electrical medical cable connector, wherein the male electrical medical cable connector comprises, two electrical conductors electrically connected to two conductive sockets within a shell of the electrical medical cable connector, wherein each of the conductive electrical sockets of the male cable connectors are connected to each of the electrical conductors; a semi-cylindrical channel formed in the shell adapted to slide over and surround the semi-cylindrical surface of the housing unit when the cable connector is inserted to make electrical contact between the cable connector and the housing unit, and further wherein the shell has a keying protrusion adapted to slide within the keying channel of the cable-receiving housing. The cable connector may further comprise a wiping portion adapted to providing a wiping action to the housed electrical connectors. Again, the housing unit may be formed from a rigid material and the cable connector is formed from a pliable material.

In yet another embodiment, an electrical medical cable connector is contemplated, comprising: a shell; two electrical conductors each electrically connected to a conductive ring electrically insulated from each other in a socket within the shell; a semi-cylindrical channel formed in the shell adapted to slide over and surround a semi-cylindrical surface of a housing unit into which the cable connector is inserted to make electrical contact between the cable connector and the housing unit; and a keying protrusion located on the exterior of the shell. The electrical medical connector may further comprise an expandable tube in the shell surrounding the socket. The electrical medical cable connector may further comprise a wiping portion adapted to provide a wiping action to an electrical connector of the housing unit into which the cable connector is inserted to make electrical contact between the cable connector and the housing unit. The electrical medical cable connector may further comprise a light covering portion extending over the channel and adapted to cover a light disposed within the channel when the cable connector is inserted in the housing unit to make electrical contact between the cable connector and the housing unit.

In yet another embodiment, an electrical medical connector apparatus is provided comprising: a housing unit and an electrical medical cable connector, the housing unit having an interior chamber, the housing unit forming a semi-cylindrical surface extending into the interior chamber and a channel for receiving a keying protrusion, the housing unit further comprising a housed electrical connector therein, comprising two conductive sleeves electrically insulated from each other, and a front end having an aperture for receiving the electrical medical cable connector, wherein the electrical medical cable connector comprises, two electrical conductors each electrically connected to a conductive ring electrically insulated from each other in a socket within a shell of the electrical medical cable connector; and a semi-cylindrical channel formed in the shell adapted to slide over and surround the semi-cylindrical surface of the housing unit when the cable connector is inserted to make electrical contact between the cable connector and the housing unit and further wherein an expandable tube in the shell surrounds the socket. The electrical medical connector may further comprise a wiping portion adapted to provide a wiping action to the housed electrical connector and the housing unit may be formed from a rigid material and the connector may be formed from a pliable material.

In yet another embodiment, a medical connector apparatus is provided comprising: a female mating connector having a semi-cylindrical interior chamber housing with an electrical connector therein comprising two conductive sleeves electrically insulated from each other, each connection formed from a ring contact on an end of the receptive connectors, a light pipe having a light therein extending along the interior chamber and a keying channel, wherein the interior chamber of the female mating connector is adapted to slidable receive a male mating connector having a socket including two conductive rings electrically insulated from each other, each for receiving the corresponding sleeve of the female mating connector. The male mating connector may further comprise an expandable tube surrounding the socket, the expandable tube expanding when the socket makes electrical connection with the male mating connector. The female mating connector may be formed of a material of greater rigidity than the male mating connector.

In another embodiment, an electrical medical connector apparatus comprising: a housing unit having a semi-cylindrical portion, the semi-cylindrical portion comprising an interior chamber, a semi-cylindrical surface extending into the interior chamber, two housed electrical connectors each connector comprising two conductive sleeves electrically insulated from each other, a keying channel, and a front end having a first aperture for receiving a cable connector. The housing unit may further comprise a bottom wall including a second aperture connected with the interior chamber to provide an outlet for environmental residue within the interior chamber when the cable connector is inserted into the first aperture to make an electrical connection with the housing unit. The apparatus may further comprise a cable connector inserted into the first aperture of the housing unit, wherein the cable connector comprises four electrical conductors, each electrically connected to the corresponding conductive sleeve of the housed electrical connectors. The cable connector may further comprise two sockets, each socket comprising two conductive rings electrically insulated from each other, each conductive ring electrically connected to the corresponding electrical conductor. An expandable tube may be provided to surround each socket, the expandable tube expanding when the sockets make electrical connection with the housed electrical connectors. The cable connector may further comprise a wiping portion adapted to provide a wiping action to the housed electrical connectors. The cable connector may further comprise a semi-cylindrical channel formed in the exterior of the cable connector, the semi-cylindrical channel adapted to slide over and surround a semi-cylindrical surface of the housing unit when the cable connector is inserted in the housing unit. A light covering portion may be provided in the cable connector which surrounds a semi-cylindrical surface of the housing unit when the cable connector is inserted into the housing unit.

In yet another embodiment, an electrical medical cable connector is provided comprising: a shell; four electrical conductors, each electrically connected to a conductive ring in two sockets, each socket including two conductive rings electrically insulated from each other, within the shell; a semi-cylindrical channel formed in the shell adapted to slide over and surround a semi-cylindrical surface of a housing unit into which the cable connector is inserted to make electrical contact between the cable connector and the housing unit; and a keying channel. The medical cable connector may further comprise an expandable tube in the shell surrounding each socket. Alternatively, the medical cable connector may further comprise a wiping portion adapted to provide a wiping action to the electrical connectors of the housing unit into which the cable connector is inserted to make electrical contact between the cable connector and the housing unit. A light covering portion may be provided on the electrical medical cable connector that extends over the channel and is adapted to cover a light disposed within the channel when the cable connector is inserted in the housing unit to make electrical contact between the cable connector and the housing unit.

In yet another embodiment, an electrical medical connector apparatus comprising: a housing unit and an electrical medical cable connector, the housing unit having an interior chamber, the housing unit forming a semi-cylindrical surface extending into the interior chamber and a keying channel, the housing unit further comprising two housed electrical connectors therein, each connector comprising two conductive sleeves electrically insulated from each other, and a front end having an aperture for receiving the electrical medical cable connector. The electrical medical cable connector comprises, four electrical conductors each electrically connected to a conductive ring, wherein two sockets each include two conductive rings electrically insulated from each other, within a shell of the electrical medical cable connector; and a semi-cylindrical channel formed in the shell adapted to slide over and surround the semi-cylindrical surface of the housing unit when the cable connector is inserted to make electrical contact between the cable connector and the housing unit and further wherein an expandable tube in the shell surrounds the socket. The electrical medical cable connector may have a keying protrusion corresponding to the keying channel of the housing unit. The cable connector may further comprise a wiping portion adapted to provide a wiping action to the housed electrical connectors. The housing unit may also be formed from a rigid material and the cable connector may be formed from a pliable material.

In another embodiment, an electrical medical connector apparatus is provided comprising: a housing unit and an electrical medical cable connector, the housing unit having an interior chamber, the housing unit forming a semi-cylindrical surface extending into the interior chamber and a second surface extending into the interior chamber forming a keying channel, the housing unit further comprising two housed electrical connectors therein, each connector comprising two conductive sleeves electrically insulated from each other, and a front end having a first aperture for receiving the electrical medical cable connector and a bottom wall including a second aperture connecting with the interior chamber to provide an outlet for environmental residue. The electrical medical cable connector comprises, four electrical conductors each electrically connected to a conductive ring, wherein two sockets each include two conductive rings electrically insulated from each other, within a shell of the electrical medical cable connector; and a semi-cylindrical channel formed in the shell adapted to slide over and surround the semi-cylindrical surface of the housing unit when the cable connector is inserted into the first aperture to make an electrical connection with the housing unit. Additionally, a keying protrusion may be formed in the shell adapted to correspond to the keying channel of the housing unit. The cable connector may further comprise a wiping portion adapted to provide a wiping action to the housed electrical connectors. Again, the housing unit may be formed from a rigid material and the cable connector may be formed from a pliable material.

DETAILED DESCRIPTION OF THE INVENTION

The following discussion is presented to enable a person skilled in the art to make and use the invention. Various modifications to the preferred embodiment will be readily apparent to those skilled in the art, and the generic principles defined herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

The invention is a medical connector apparatus that includes: (1) a female housing having at least a first conductive portion, (2) a male mating connector having at least a second conductive portion, wherein the female housing conductive portion and the male mating connector conductive portion electrically couple when mated. A keying protrusion, for example in the form of a knob or rib, is provided on the male mating connector. The keying protrusion functions to limit the ability of the male cable connector from mating with a female housing unless the female housing has a channel formed in the housing corresponding to the keying protrusion of the male cable connector.

Figure 1:
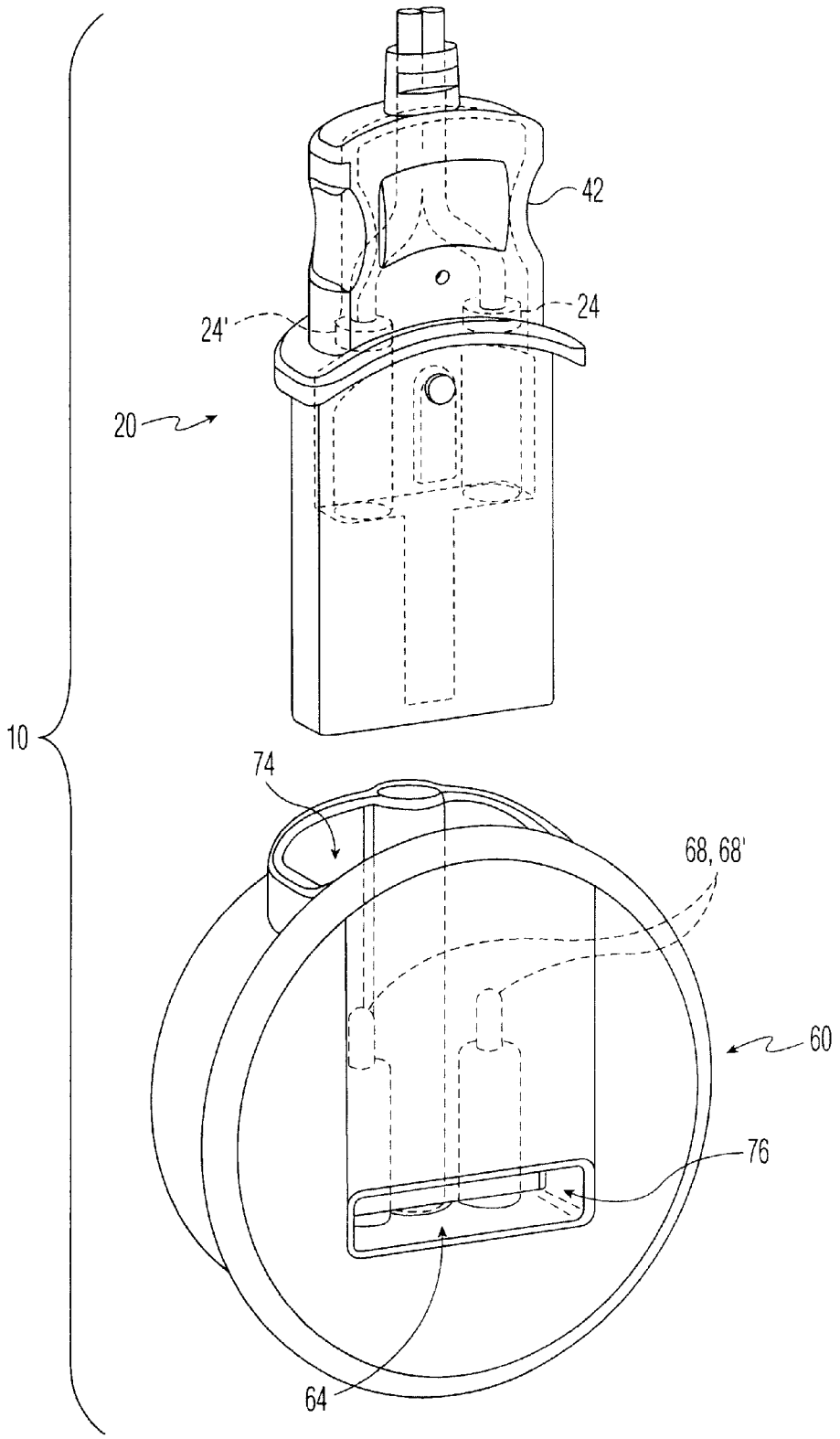
FIG. 1 PRIOR ART
FIG. 1 illustrates a presently available medical connector apparatus having a male cable connector and a female cable receiving housing.

FIG. 1 illustrates a medical connector apparatus 10 used by Heart stream Inc. (Seattle Wash.). The medical connector apparatus includes (1) a male cable connector 20 having two conductive sockets, and (2) a female cable-receiving housing 60 having two conductive pins for coupling to the two conductive sockets on the male cable connector. The female cable-receiving housing 60 has two apertures 74, 76 that extend between interior chamber 64 and the exterior of the housing unit 60. First aperture 74 is formed on the top side of housing unit 64. Through this aperture, male cable connector 20 is inserted into the interior chamber 64 of the female cable-receiving housing 60 to couple sockets 24, 24' of the male cable connector 20 to pins 68, 68' of the female cable-receiving housing 60.

Second aperture 76, on the other hand, is formed on the flat back side of the housing unit. The second aperture 76 serves as an outlet for environmental residue that may be present in the interior chamber. Specifically, when the male cable connector 20 is inserted through the first aperture 74 of the female cable-receiving housing 60, environmental residue is forced out of the interior chamber 64 through this second outlet 76, because of the depression force created by the insertion of the male cable connector 20.

Further details of the medical connector apparatus of FIG. 1 are described in more detail in U.S. Pat. No. 5,967,817 to Green stein for Medical Connector Apparatus, the specification of which is incorporated herein.

Figure 2A:
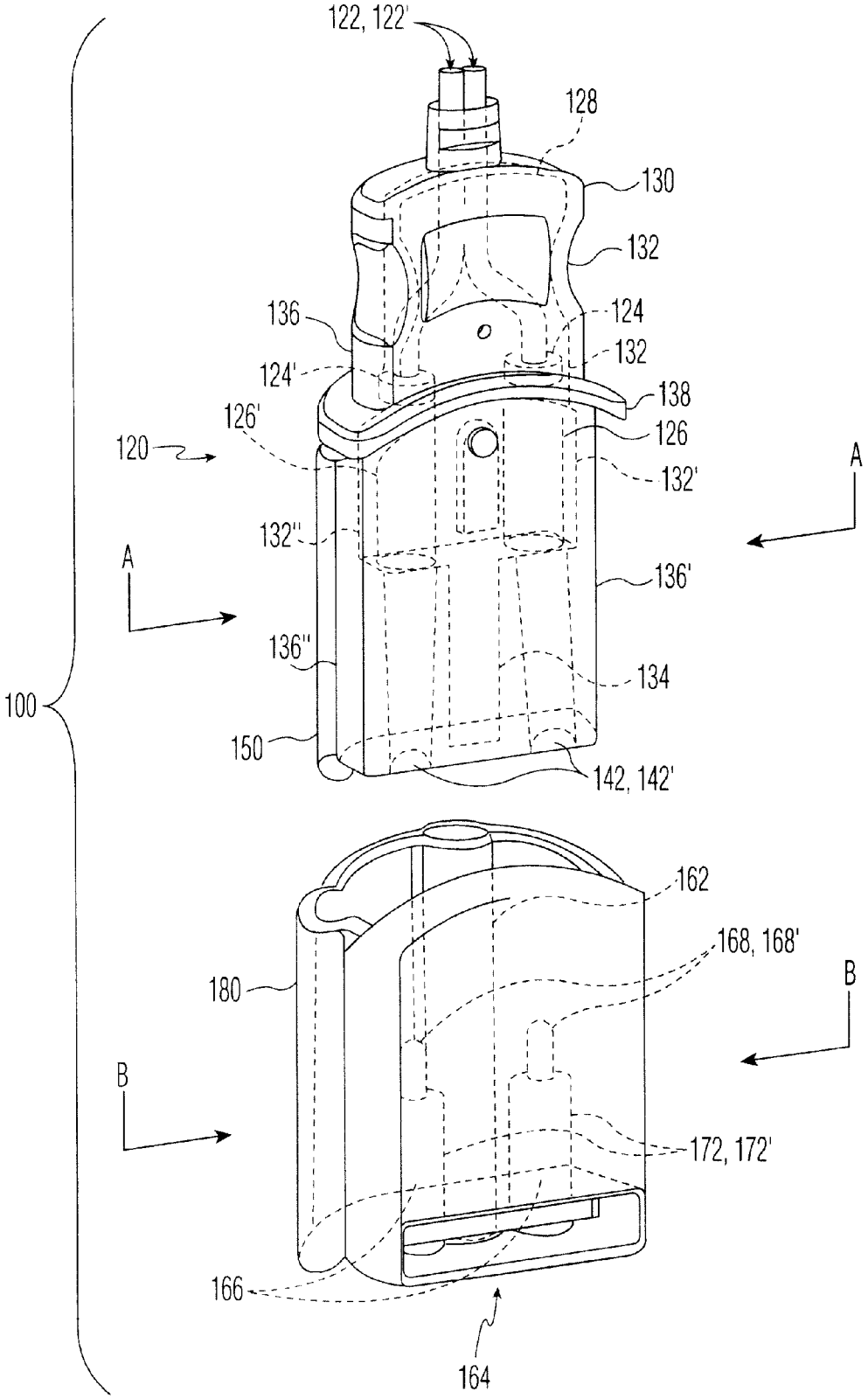
FIG. 2A illustrates a medical connector apparatus according to the present invention having a male connector further having a keying rib and a female receiving housing with a keying channel corresponding to the keying rib of the male cable connector.

Turning now to the embodiment of the invention shown in FIG. 2A, a connector apparatus 100 is shown. The connector apparatus 100 comprises a male cable connector 120 and a female cable-receiving housing 160. As will be appreciated by those of skill in the art, the cable-receiving housing may be integral with the receiving device, e.g., the defibrillator, or it may be a housing incorporated into the receiving device housing.

Male cable connector 120 includes in this embodiment includes two insulated electrical conductors 122, 122' in the form of wires, and two conductive sockets 124, 124', that connect electrode pads (not shown) to the cable connector 120. In operation, the sockets, make electrical contact between the electrode pads (not shown) and conductive pins 168, 168' in assembly 160. Additional information relating to an electrode pad appropriate for use in a defibrillator can be found in U.S. Pat. No. 5,951,598 for Electrode System to Bishay et al., the specification of which is incorporated herein. Other electrode pads appropriate for use in this invention will be apparent to those of skill in the art and are not described herein in order to avoid obscuring the invention.

As will be further appreciated by those of skill in the art, a variety of electrical connector arrangements can be used without departing from the scope of the invention. These include, for example, providing two conductive rings electrically insulated from each other for a single socket. Where this scenario is employed, one or more sockets may be employed. Additional connector arrangements have not been described in order to avoid obscuring the invention, but would be readily apparent to those of skill in the art.

In attaching to the cable connector 120, electrical conductors 122, 122' electrically connect to the conductive sockets 124, 124'. Connection is typically achieved by crimping the conductive sockets 124, 124' onto a corresponding wire of the electrical conductors 122, 122'.

The housing of the male cable connector 120 may be formed from a variety of assemblies. Two such assemblies are described herein for purposes of illustration. In one illustration, connector 120 is formed from two silicone tubes 126, 126', a rigid inner encasing shell 128, and an elastic outer encasing shell 130. The housing is formed of a shell that is manufactured from a non-conductive polymer (such as nylon or polyester shell). The inner encasing shell 128 is injection molded around tubes 126, 126', sockets 124, 124', and conductors 122, 122'. The encasing shell 128 itself forms three rigid encasing portions 132, 132', 132", and a supporting portion 134. The first rigid encasing portion 132 is molded around the connector end of electrical conductors 122, 122' and the crimped end of conductive sockets 124, 145'. Each of the other two rigid encasing portions 132', 132" encases a conductive socket 124, 124' and its corresponding silicone tube 126, 126'; together each forms a tube housing. The three rigid encasing portions 132, 132' 132" insulate the two conductive paths (each of which is formed by an electrical conductor 122, 122' and a socket 124, 124') from each other and from a user.

Figure 2B:
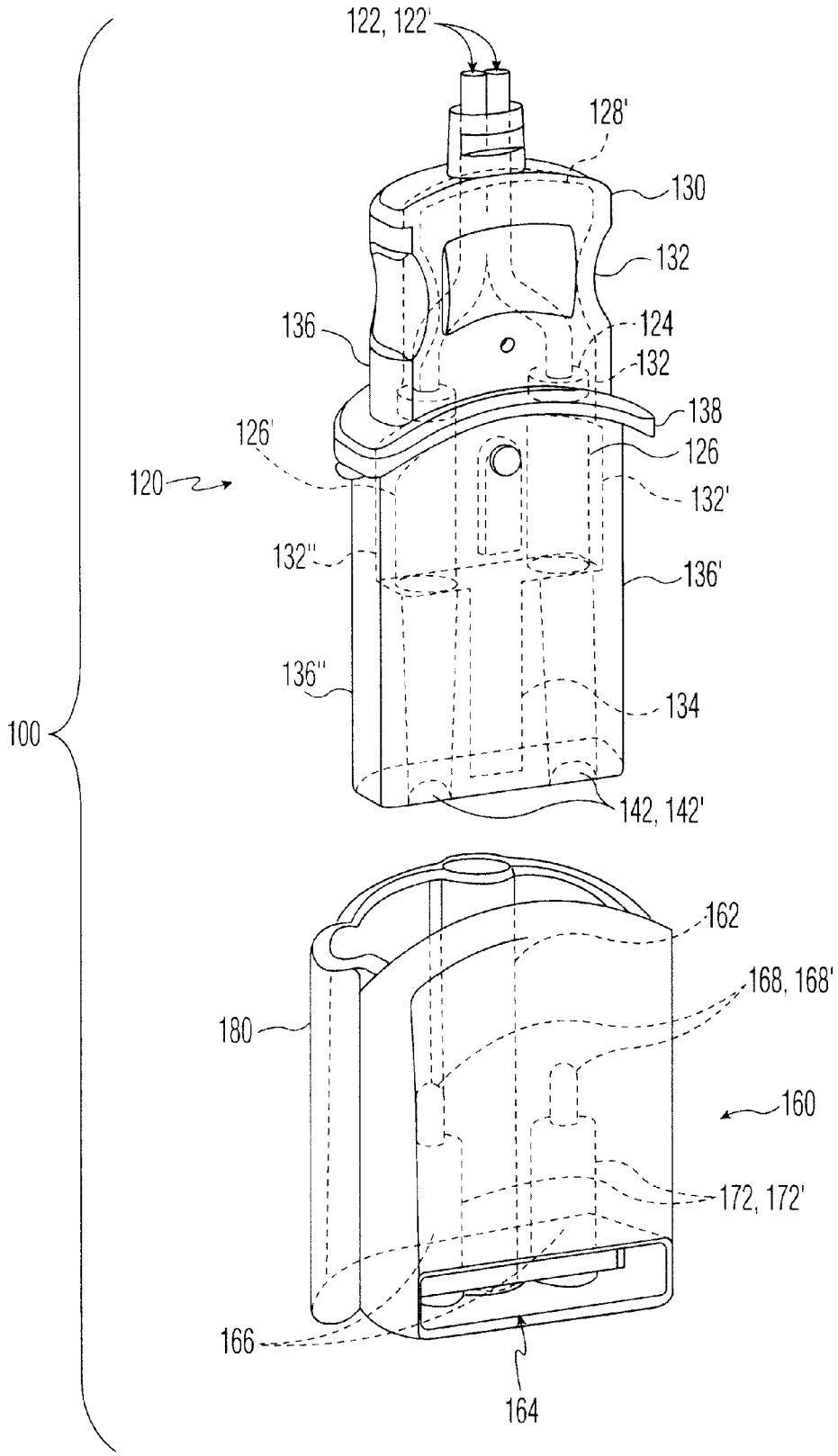
FIG. 2B illustrates a medical connector apparatus combination according to the present invention having a male connector without a keying rib and a female receiving housing with a keying channel.

In the alternative illustration of FIG. 2B, connector 120 is formed from a rigid inner encasing shell 128' and an elastic outer encasing shell 130. The housing is formed from a shell that is manufactured from a non-conductive polymer (such as nylon or polyester shell). The inner encasing shell 128' itself is injection molded to form three rigid encasing portions 132, 132' 132", and a supporting portion 134. After connecting sockets 124, 124' to conductors 122, 122', sockets 124, 124' are snapped into rigid encasing portions 132', 132" from the side opposite 134; each forming a tube housing. Rigid encasing portion 132 encapsulates the connector end of electrical conductors 122, 122' and the crimped end of conductive sockets 124, 124'. The three rigid encasing portions 132, 132' 132" insulate the two conductive paths (each of which is formed by an electrical conductor 122, 122' and a socket 124, 124') from each other and from a user.

The rigid encasing shell 128, 128' also includes supporting portion 134, that extends downwardly from the second and third rigid encasing portions 132, 132'. This supporting portion 134 serves as a support for the center of elastic encasing shell 130, which is molded around the rigid encasing shell 130. As illustrated, elastic encasing shell 130 in turn comprises three elastic encasing portions 136, 136', 136", a flange 138, and a semi-cylindrical channel 140 (FIG. 4A) formed along a portion of its length. The elastic shell's primary elastic encasing portion 136 surrounds first rigid encasing portion 132 of shell 128, 128'. As shown in FIGS. 2A and 2B, primary elastic encasing portion 136 has inward bends 142, 142' that enable a user to securely grip and hold male cable connector 120. As will be appreciated by those of skill in the art, other arrangements may be employed to enable the user to grip the male connector without departing from the scope and spirit of the invention.

In addition, elastic encasing shell 130 includes secondary and tertiary encasing portions 136', 136", that respectively surround the tube housing formed from the rigid encasing portions 132', 132". Moreover, the secondary and tertiary encasing portions 136', 136" extend downwardly below tube housing 132', 132" to define two chambers 142, 142'. Each of these chambers 142, 142' is axially aligned with one socket 124, 124' and its corresponding silicone tube 126, 126', so that, when the male cable connector 120 is inserted into the interior chamber of the female cable-receiving housing 160, a pin 168, 168' projects through the chamber to reach its corresponding socket 124, 124' within the tube housing.

A semi-cylindrical channel 140 (FIG. 4A) is defined on the front side (not shown in FIGS. 2A and 2B) of elastic shell 130 between second encasing portion 136' and tertiary encasing portion 136". This channel 140 (which is supported by supporting portion 134) prevents the second and tertiary encasing portions 132', 132" from dangling from the end of second and tertiary encasing portions 132', 132". In addition, as further discussed below, when male cable connector 120 is inserted into the interior chamber of the female cable-receiving housing 160, the channel 140 of the male cable connector 120 slides across a semi-cylindrical rib 162 formed from, for example, a light pipe housed in female cable-receiving housing 160.

Elastic shell 130 further includes flange 138 between first encasing portion 136 and second and third encasing portions 136' 136". Flange 138 prevents the housing from being further inserted into the female cable-receiving housing 160.

Keying protrusion 150 is provided on the exterior surface of the elastic shell 130. The protrusion can be, for example, in the form of a rib, running along the length of the shell, or a knob formed along its length. Further, keying protrusion 150 may be formed from one or more protruding sections. The keying protrusion 150 prevents the male cable connector 120 from being inserted into a housing which has not been configured to mate with the keying protrusion (such as the female cable-receiving housing 60 shown in FIG. 1). Some or all of keying protrusion 150 may be formed by a hard plastic which is part of rigid encasing shell 128, or by any other suitable material.

As shown in FIGS. 2A and 2B, medical connector apparatus 100 also includes a female cable-receiving housing 160 that houses, in an interior chamber 164, a housed connector 166. Housed connector 166 is configured to mate with the male cable connector 120. In this embodiment, housed connector 166 includes two conductive pins 168, 168', which extend vertically upwards from the bottom end of the interior chamber 164. The housed connector 166 also includes two insulating columns 172, 172', each of which surrounds a pin so as to leave only a portion of the pin exposed. The arrangement of columns 172, 172' to pins 168, 168' is commonly referred to as a pin-and-post arrangement. As will be appreciated by those of skill in the art, and as described above, other connector arrangements may be employed without departing from the scope of the invention.

As shown in FIGS. 2A and 2B, the inner recess of interior chamber 164 of the female cable-receiving housing 160 and the outer elastic shell of male cable connector 120 are molded in a complementary fashion. In particular, as shown in FIGS. 2A and 2B, the bends on the corners of the front side of interior chamber 164 provide two channels supporting the curve front side of encasing portions 136', 136". In addition, semi-cylindrical channel 140 of male cable connector 120 provides a complementary surface to the cylindrical outer surface of light pipe 162. Also, the backside of both outer elastic shell 10 of the male cable connector 120 and interior chamber 164 of the female cable-receiving housing 160 are substantially flat.

The interior surface of the interior chamber 164 of the female cable-receiving housing 160 further includes a channel 180 corresponding to the keying protrusion 150 of the male cable connector. Importantly, the channel 180 enables the male cable connector 120 to mate with the female cable-receiving housing 160 while not preventing male cable connector 20 (FIG. 1) from mating with the female cable-receiving housing 160 (as shown in FIG. 2B).

As will be appreciated by those of skill in the art, the male cable connector 120 or the female cable-receiving housing 160 may be configured as part of an adapter system. Thus, for example, an adapter could be configured to receive a non-compatible electrode pad on one end and to form a male cable connector 120 on the other end; enabling the non-compatible electrode pad to be attached to a device having the female cable-receiving housing 160. Alternatively, a female cable-receiving housing 160, instead of being incorporated into a defibrillator housing, could be configured on an adapter to receive a male cable connector 120 on one end while being capable of connecting to a non-compatible defibrillator on the other end; enabling the electrode pad to be attached to a device that does not have a female cable-receiving housing 160. Specific embodiments of the adapter arrangements are shown in more detail in FIGS. 3A and 3B.

Figure 3A:
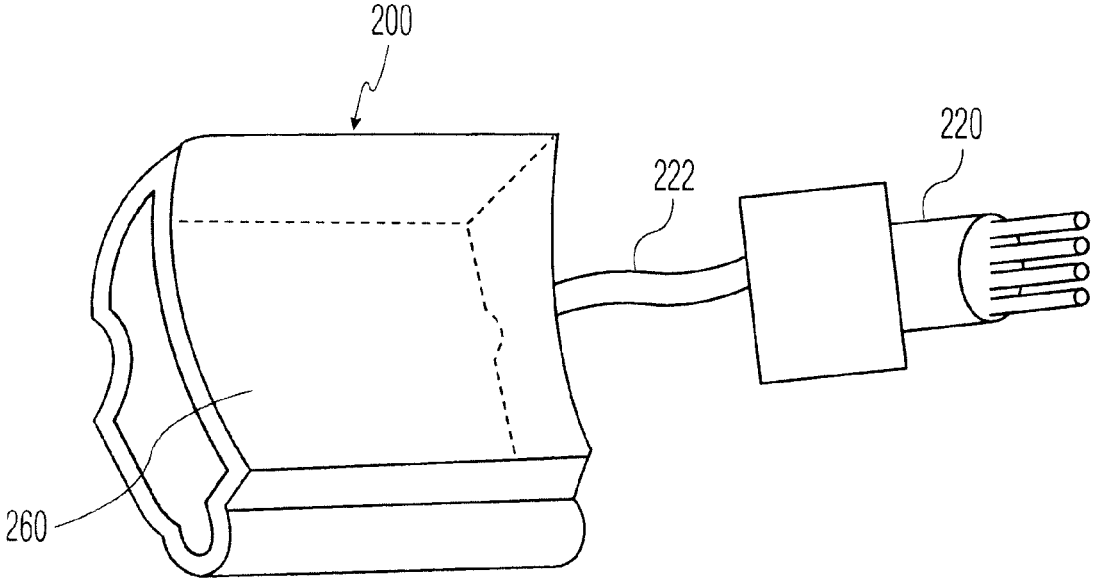
FIG. 3A illustrates an adapter for connecting a set of electrode pads not configured to operate in the system to the female connector of the system with the keying channel of FIG. 2A.

Turning now to FIG. 3A, an adapter 200 is illustrated for connecting a set of electrode pads having the male cable connector 120 of this invention to a cable-receiver. The adapter 200 features a female cable-receiving housing 260 on one end and a connector 220 on the other end. The female cable-receiving housing 260 is electrically connected to connector 220 by, for example, a wire interface 222. Of course, as will be appreciated by those of skill in the art, the female cable-receiving housing 260 and the connector 220 may be formed integrally, thus forming a one piece adapter. Further, the electrode connector 220 may be any of a number of configurations. Configurations include male and female configurations, and will depend entirely on the configuration of the electrode receiver of the defibrillator that the male cable connector 120 is to be adapted to. For purposes of illustration, the connector has been shown as a four pin male connector. It should also be appreciated that the adapter can have the male and female ends formed integrally (as shown) or, alternatively, formed by connecting the male and female ends together with an appropriate electrical connector, such as a wire.

Figure 3B:
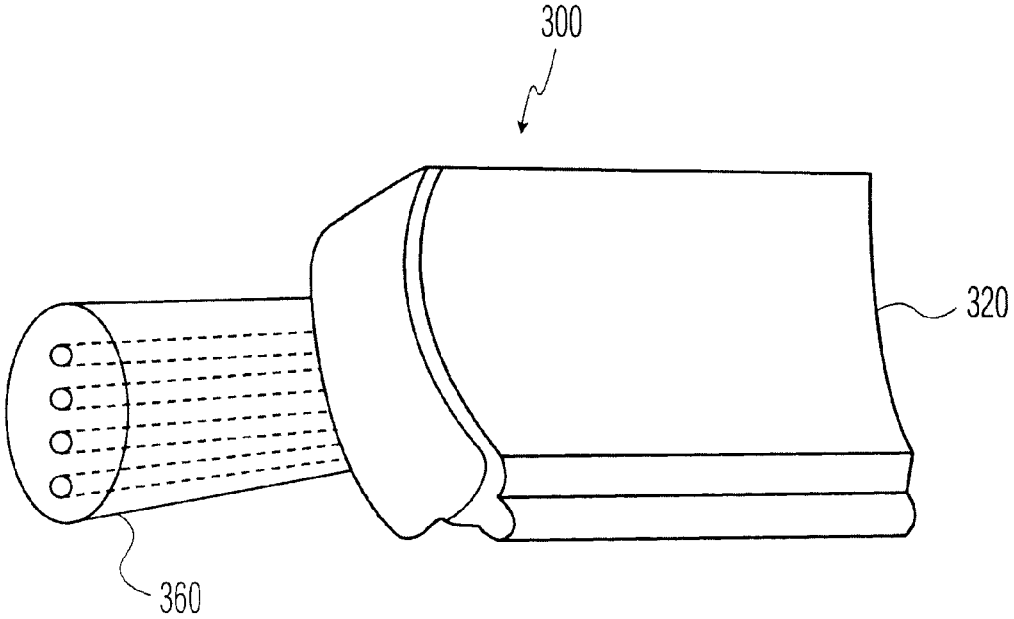
FIG. 3B illustrates an adapter for connecting the male connector of the system with a keying rib of FIG. 2A to female connector of another connector system.

FIG. 3B illustrates an adapter 300 for connecting a set of electrode pads that do not have the male cable connector 120 to the female cable-receiving housing 160. The adapter 300 features a male cable connector 320 on one end and an electrode adapter 360. Again, it will be appreciated by those of skill in the art, the electrode adapter 360 can be any of a number of configurations. Configurations include male and female configurations or combinations thereof, and will depend entirely on the configuration of the electrode connector of the electrode pads that are to be adapted to be received by the female cable-receiving housing 160. For purposes of illustration, the adapter has been shown as a female housing capable of receiving a four pin male connector (such as that shown in FIG. 3A). As with the above-described adapter configuration, it will also be appreciated that the adapter can have the male and female ends formed integrally (as shown) or, alternatively, formed by connecting the male and female ends together with an appropriate electrical interface, such as a wire.

Figure 4A:
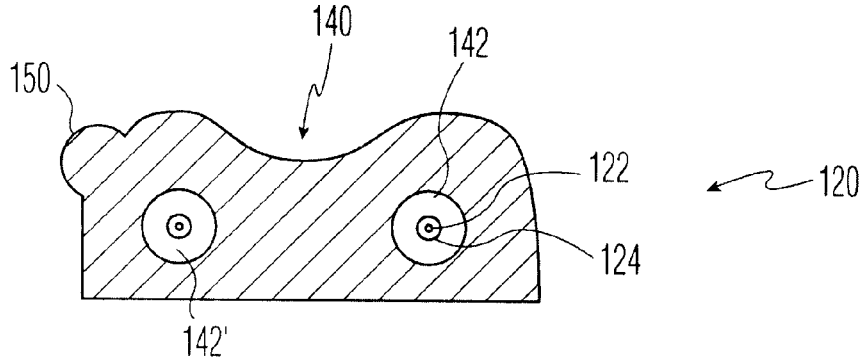
FIG. 4A illustrates a cross-sectional view of the male portion of the housing shown in FIG. 2 across the lines A—A shown in FIG. 2A.

FIG. 4A illustrates a cross-section of the male cable connector 120 shown in FIG. 2A across the lines A—A. The male cable connector has a keying protrusion 150 formed on the exterior surface of the elastic shell. Two interior chambers 142, 142' are provided. Within each interior chamber is a socket 124, 124' inside an encasing portion 122, 122'.

Figure 4B:
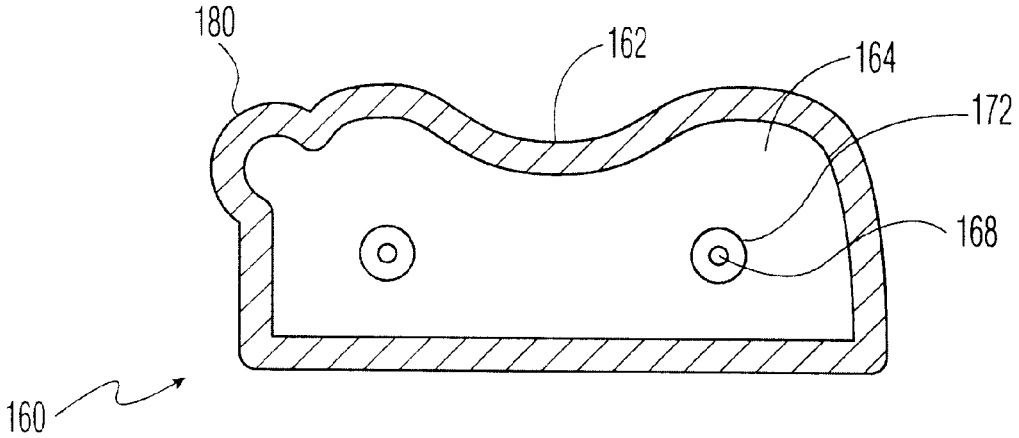
FIG. 4B illustrates a cross-sectional view of the female portion of the connector shown in FIG. 2 across the lines B—B shown in FIG. 2A.

FIG. 4B illustrates a cross-section of the female cable-receiving housing 160 shown in FIG. 2A across the lines B—B. The female cable-receiving housing 160 has a channel 180 for receiving the keying protrusion 150 of the male cable connector.

What is claimed:

1. An electrical medical connector apparatus comprising: a cable-receiving housing having an interior chamber, a semi-cylindrical surface extending into the interior chamber, two housed electrical connectors, a front end having a first aperture for receiving a male cable connector and the cable receiving housing having a keying channel extending out of the interior chamber from the front end, along a portion of the length of the interior chamber.

2. The electrical medical connector apparatus of claim 1 wherein the male cable connector further comprises a light covering portion surrounded by semi-cylindrical surface of housing unit when the male cable connector is inserted in the housing unit.

3. The electrical medical connector apparatus of claim 1 further comprising a male cable connector inserted into the first aperture of the cable-receiving housing, the male cable connector comprising two electrical conductors electrically connected to the housed electrical connectors.

4. The electrical medical connector apparatus of claim 3 wherein the male cable connector further comprises a wiping portion adapted to providing a wiping action to the housed electrical connectors.

5. The electrical medical connector apparatus of claim 3 wherein the male cable connector further comprises a semi-cylindrical channel formed in the exterior of the male cable connector, the semi-cylindrical channel adapted to slide over and surround a semi-cylindrical surface of the cable-receiving housing when the cable connector is inserted into the cable-receiving housing.

6. The electrical medical connector apparatus of claim 3 wherein the male cable connector further comprises a keying protrusion along a portion of its length corresponding to the keying channel of the cable-receiving housing.

7. The electrical medical connector apparatus of claim 3 wherein the male cable connector further comprises a conductive socket electrically connected to each of the two electrical conductors and an expandable tube surrounding each conductive socket, the expandable tubes expanding when the sockets make electrical connection with the housed electrical connectors.

8. The electrical medical connector apparatus of claim 7 wherein the male cable connector further comprises a light covering portion surrounded by semi-cylindrical surface of housing unit when the male cable connector is inserted in the housing unit.

9. An male cable connector comprising:

a shell having an interior surface and an exterior surface;

two electrical conductors electrically connected to two conductive sockets forming the interior surface of the shell;

a semi-cylindrical channel formed in the shell adapted to slide over and surround a semi-cylindrical surface of a housing unit into which the cable connector is inserted to make electrical contact between the cable connector and the housing unit; and a keying protrusion located on the exterior of the shell.

10. The male cable connector of claim 9 further comprising a wiping portion adapted to providing a wiping action to electrical connectors of a cable-receiving housing into which the male cable connector is inserted to make electrical contact between the cable connector and the housing unit.

11. The male cable connector of claim 10 further comprising a light covering portion extending over the channel and adapted to cover a light disposed within the channel when the male cable connector is inserted in the housing unit to make electrical contact between the cable connector and the housing unit.

12. A medical connector apparatus comprising: a cable-receiving housing and an electrical medical cable connector, the cable-receiving housing having an interior chamber, the cable-receiving housing forming a semi-cylindrical surface extending into the interior chamber, the cable-receiving housing further forming a keying channel extending out of the interior chamber from the front end of the cable-receiving housing along a portion of the length, the cable-receiving housing further comprising two housed electrical connectors therein, and a front end having an aperture for receiving a male cable connector, wherein the male cable connector comprises, two electrical conductors electrically connected to two conductive sockets within a shell of the male cable connector, wherein each of the conductive electrical sockets of the male cable connector are connected to each of the electrical conductors; and a semi-cylindrical channel formed in the shell adapted to slide over and surround the semi-cylindrical surface of the housing unit when the cable connector is inserted to make electrical contact between the cable connector and the housing unit.

13. The electrical medical connector apparatus of claim 12 wherein the cable connector further comprises a wiping portion adapted to providing a wiping action to the housed electrical connectors.

14. The electrical medical connector apparatus of claim 12 wherein the housing unit is formed from a rigid material and the cable connector is formed from a pliable material.

15. An electrical medical connector apparatus comprising: a cable-receiving housing and an electrical medical cable connector, the cable-receiving housing having an interior chamber, the cable-receiving housing forming a semi-cylindrical surface extending into the interior chamber, the cable-receiving housing further forming a keying channel extending of the interior chamber from the front end of the cable-receiving housing along a portion of the length, the cable-receiving housing further comprising two housed electrical connectors therein, and a front end having an aperture for receiving an electrical medical cable connector, wherein the male electrical medical cable connector comprises, two electrical conductors electrically connected to two conductive sockets within a shell of the electrical medical cable connector, wherein each of the conductive electrical sockets of the male cable connectors are connected to each of the electrical conductors; a semi-cylindrical channel formed in the shell adapted to slide over and surround the semi-cylindrical surface of the housing unit when the cable connector is inserted to make electrical contact between the cable connector and the housing unit, and further wherein the shell has a keying protrusion adapted to slide within the keying channel of the cable-receiving housing.

16. The electrical medical connector apparatus of claim 15 wherein the cable connector further comprises a wiping portion adapted to providing a wiping action to the housed electrical connectors.

17. The electrical medical connector apparatus of claim 15 wherein the housing unit is formed from a rigid material and the cable connector is formed from a pliable material.

* * * * *